US010138615B2

(12) United States Patent
Kim et al.

(10) Patent No.: US 10,138,615 B2
(45) Date of Patent: Nov. 27, 2018

(54) BASE BODY OF ELECTRIC TRANSMISSION TOWER USING MICROPILE

(71) Applicant: KOREA ELECTRIC POWER CORPORATION, Naju-si, Jeollanam-do (KR)

(72) Inventors: Dae Hong Kim, Daejeon (KR); Won Sam Pyo, Seongnam-si (KR); Jang Goon Kim, Daejeon (KR); Dae Soo Lee, Daejeon (KR)

(73) Assignee: KOREA ELECTRIC POWER CORPORATION, Naju-si, Jeollanam-do (KR)

( * ) Notice: Subject to any disclaimer, the term of this patent is extended or adjusted under 35 U.S.C. 154(b) by 0 days.

(21) Appl. No.: 15/314,844

(22) PCT Filed: May 19, 2015

(86) PCT No.: PCT/KR2015/005027
§ 371 (c)(1),
(2) Date: Nov. 29, 2016

(87) PCT Pub. No.: WO2016/043406
PCT Pub. Date: Mar. 24, 2016

(65) Prior Publication Data

US 2017/0191239 A1 Jul. 6, 2017

(30) Foreign Application Priority Data

Sep. 17, 2014 (KR) ..... 10-2014-0123913

(51) Int. Cl.
*E02D 27/42* (2006.01)
*E04H 12/22* (2006.01)
(Continued)

(52) U.S. Cl.
CPC ..... *E02D 27/42* (2013.01); *E02D 5/22* (2013.01); *E04H 12/2238* (2013.01);
(Continued)

(58) Field of Classification Search
CPC ..... E02D 27/42; E02D 27/28; E02D 5/22; E04H 12/22; E04H 12/2238
(Continued)

(56) References Cited

U.S. PATENT DOCUMENTS 5,533,835 A * 7/1996 Angelette ..... E02D 27/42 405/229
6,540,196 B1 * 4/2003 Ellsworth ..... E01F 9/642 248/548
(Continued)

FOREIGN PATENT DOCUMENTS

CN 203755336 U 8/2014
JP 2008-223303 A 9/2008
(Continued)

OTHER PUBLICATIONS

International Search Report issued in Application No. PCT/KR2015/005027, dated Aug. 25, 2015, with English Translation.
(Continued)

*Primary Examiner* — Adriana Figueroa
(74) *Attorney, Agent, or Firm* — McDermott Will & Emery LLP

(57) ABSTRACT

Disclosed is a base body of an electric transmission tower using a micropile. The base body of the electric transmission tower using the micropile includes an anchor member coupled to a main pole member of the electric transmission tower, a foundation member coupled to the anchor member and including a plurality of foundations, and the micropile configured to fix the foundation member to the ground and compress the foundation member.

11 Claims, 17 Drawing Sheets

(51) Int. Cl.
*E02D 5/22* (2006.01)
*E04H 12/10* (2006.01)
*E02D 11/00* (2006.01)

(52) U.S. Cl.
CPC ..... *E02D 11/00* (2013.01); *E02D 2250/003* (2013.01); *E02D 2300/002* (2013.01); *E02D 2300/0021* (2013.01); *E02D 2300/0025* (2013.01); *E02D 2300/0026* (2013.01); *E04H 12/10* (2013.01)

(58) Field of Classification Search
USPC ..... 52/169.9, 294, 295
See application file for complete search history.

(56) References Cited

U.S. PATENT DOCUMENTS 6,702,522 B2 * 3/2004 Silber ..... E02D 27/42 405/229
7,374,369 B2 * 5/2008 Jakubowski ..... E02D 27/42 405/233
8,161,698 B2 * 4/2012 Migliore ..... E02D 27/42 52/169.9
8,220,214 B1 * 7/2012 Purdy ..... E02D 27/42 248/678
9,322,396 B2 * 4/2016 Coordes ..... E02D 27/42
2009/0279959 A1 * 11/2009 Bakos ..... E02D 27/42 405/231
2012/0291380 A1 * 11/2012 Tooman ..... E02D 31/002 52/297

FOREIGN PATENT DOCUMENTS

KR 20-0354125 Y1 6/2004
KR 10-2009-0129138 A 12/2009
KR 10-0943062 B1 2/2010
KR 10-2010-0130273 A 12/2010
KR 10-1125615 B1 3/2012
KR 10-2012-0132713 A 12/2012
KR 10-2013-0123172 A 11/2013
KR 10-1358754 B1 2/2014
KR 10-1365236 B1 2/2014

OTHER PUBLICATIONS

Chinese Office Action dated Mar. 29, 2018 issued in Chinese Patent Application No. 201580034484.4.

* cited by examiner

BASE BODY OF ELECTRIC TRANSMISSION TOWER USING MICROPILE

RELATED APPLICATIONS

This application is the U.S. National Phase under 35 U.S.C. § 371 of International Application No. PCT/KR2015/005027, filed on May 19, 2015, which in turn claims the benefit of Korean Application No. 10-2014-0123913, filed on Sep. 17, 2014, the disclosures of which Applications are incorporated by reference herein.

TECHNICAL FIELD

The present disclosure relates to a base body of an electric transmission tower using a micropile, and more particularly, to a base body of an electric transmission tower using a micropile, which is capable of reducing a construction time, costs and environmental damage and improving durability of a device by being applied with foundation members including a plurality of foundation.

BACKGROUND ART

A conventional electric transmission tower is a truss shaped steel structure constructed from the ground to a height of several tens of meters and is configured with a heavy material having a dead load in a range of several tens of tons to several hundreds of tons in order to construct electric transmission lines. Such an electric transmission tower typically has four main pole members which are disposed in square, and a lower end of each of the four main pole members is fixed to the ground by means of a concrete base body.

To construct electric transmission tower, a method of first excavating the ground and deposing a concrete surface in the excavated ground at a level, constructing and disposing four foundation concrete structures in square, and sequentially assembling the four foundation concrete structures in a truss type having angles up to a predetermined height is used to complete installation of an electric transmission tower.

A base body for supporting an electric transmission tower is generally manufactured at a construction site so that a large amount of material and equipment and a wide workspace are required. However, since a location at which an electric transmission tower is installed is a ridge of mountain, a steeply sloped land, or the like, there are problems in that transportation of materials and equipment is very difficult, environmental damage occurs due to a large scale foundation construction, and a long construction period is required.

PRIOR ART DOCUMENT

[Patent Document]

(Patent Document 1) Korean Patent Application Publication No. 10-2013-0123172 (Nov. 12, 2013)

DISCLOSURE

Technical Problem

To address the above described problems, an object of the present disclosure is to provide a base body of an electric transmission tower using a micropile, which is capable of facilitating an installation of a foundation member, reducing a period of time, costs, and manpower required for installing the foundation member, and increasing resistance thereof to tensile force.

Technical Solution

A base body of an electric transmission tower using a micropile according to the present disclosure includes an anchor member coupled to a main pole member of the electric transmission tower, a foundation member coupled to the anchor member and including a plurality of foundations, and the micropile configured to fix the foundation member to a ground and compress the foundation member.

In accordance with the present disclosure, the anchor member may include a plurality of anchor plates coupled to the foundation member and separated from each other, and an anchor pole configured to connect the plurality of anchor plates to each other and be attachably and detachably coupled to the main pole member.

In accordance with the present disclosure, each of the plurality of anchor plates may be formed in a plate shape, and the anchor pole may pass through each of the plurality of anchor plates to be coupled thereto.

In accordance with the present disclosure, each of the plurality of foundations may be precasted and coupled to the micropile.

In accordance with the present disclosure, the foundation member may include a first foundation part seated on the ground or leveled concrete and coupled to the micropile so that a position of the first foundation part is fixed, a second foundation part seated on the first foundation part and to which the anchor member is coupled, and a third foundation part seated on the second foundation part and pressurized toward the second foundation part by the micropile.

In accordance with the present disclosure, the plurality of the foundations may be coupled to each other by a foundation protrusion formed to protrude from each of adjacent surfaces being engaged with a foundation depression formed in a concave shape corresponding to the foundation protrusion.

In accordance with the present disclosure, the foundation protrusion may be disposed in a circumferential direction based on a central axis of the foundation.

In accordance with the present disclosure, the micropile may include a pile part coupled to the foundation member and having one end protruding toward an upper side of the foundation member and the other end fixed to the ground, and a movement limiting plate inserted into the foundation member and coupled to the pile part to limit movement of the pile part.

In accordance with the present disclosure, the micropile may further include a compressing part coupled to the pile part in a state in which the one end of the pile part is pulled toward an upper side, and configured to come into contact with an upper side of the foundation member and compress the foundation member.

In accordance with the present disclosure, the compressing part may include a compressing plate provided to come into contact with an upper surface of the foundation member and through which the pile part passes, and a pile fixer screw-coupled to the pile part, and configured to come into contact with an upper surface of the compressing plate and limit movement of the pile part.

In accordance with the present disclosure, the micropile may further include a pile cap part provided to surround one end of the pile part and the pile fixer, and configured to prevent the pile part and the pile fixer from being exposed to an outside.

In accordance with the present disclosure, the pile cap part may include a pile cap formed in a shape that surrounds the one end of the pile part and the pile fixer, and a cap filler injected into the pile cap and configured to prevent corrosion of the pile part.

Advantageous Effects

In accordance with the base body of an electric transmission tower using a micropile of the present disclosure, a foundation member is assembled using a plurality of foundations so that installation may be easily performed, and a period of time, costs, and manpower required for installing an electric transmission tower and environmental damage may be reduced.

Also, in accordance with the present disclosure, the foundation member is compressed using a micropile such that a tensile force, which is generated when a wind load and the like is applied to the electric transmission tower, may be counterbalanced, thereby improving durability of the foundation member.

Also, in accordance with the present disclosure, a pile cap part is provided so that corrosion of a pile part may be prevented and a performance of a device may be maintained.

MODES OF THE INVENTION

Figure 1:
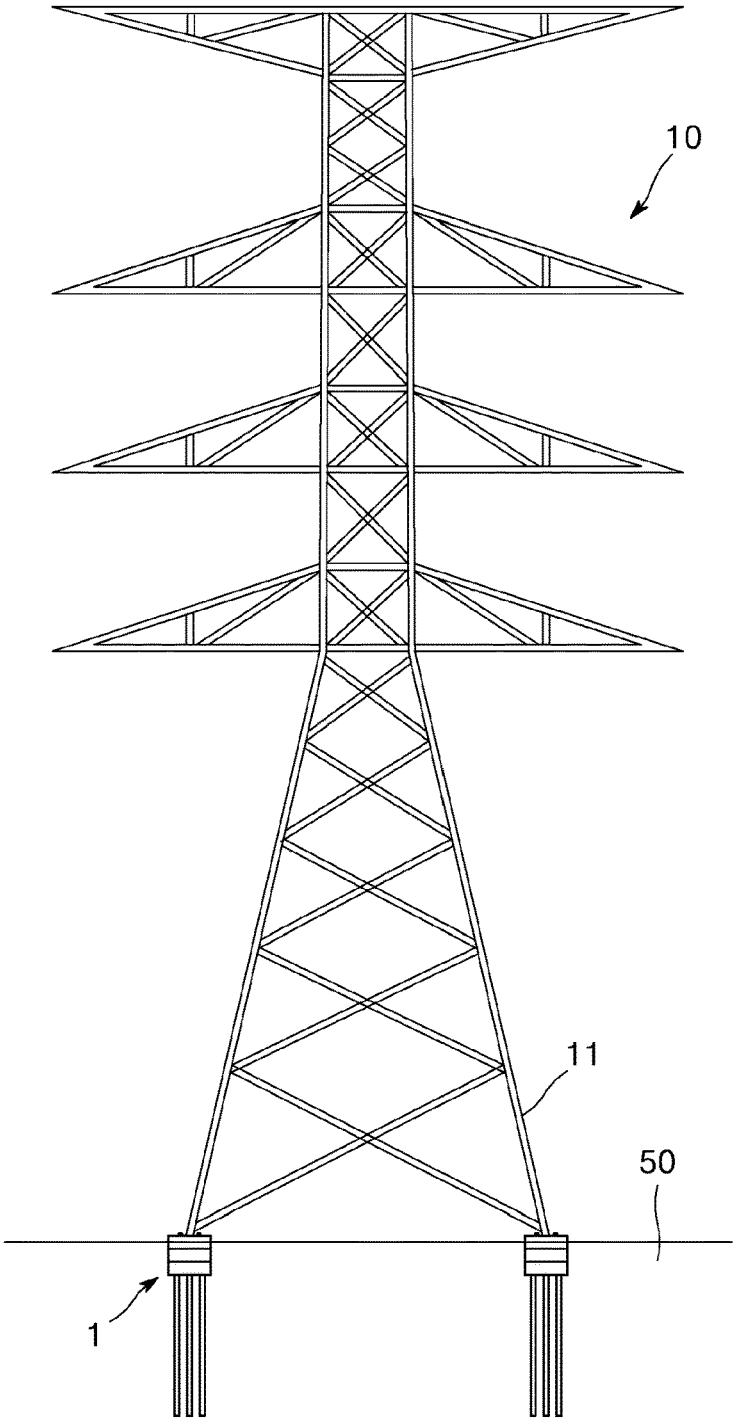
FIG. 1 is a diagram illustrating a state in which a base body of an electric transmission tower using a micropile is installed according to one embodiment of the present disclosure.

Hereinafter, embodiments of a base body of an electric transmission tower using a micropile according to the present disclosure will be described with reference to the accompanying drawings. In the course of the description, a thickness of a line, a size of a component, or the like which are shown in the drawings may be exaggerated for clarity and convenience of a description.

Also, all terms used hereinafter are selected in consideration of a function in an embodiment, and meanings thereof may be different according to the intent of a user and an operator or custom. Therefore, the definitions of these terms used in the following embodiments should be based on the content disclosed herein.

Figure 2:
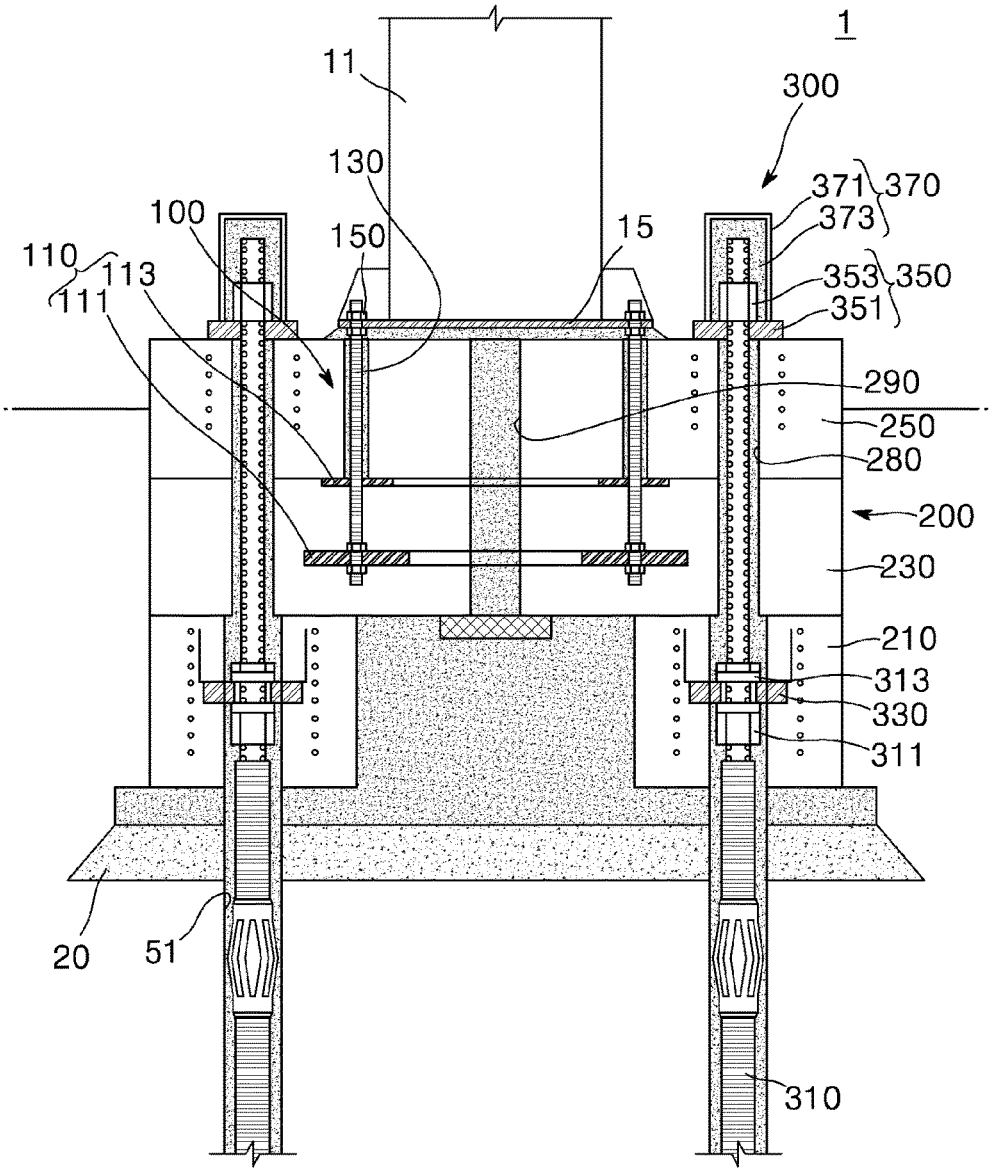
FIG. 2 is a diagram illustrating a cross section of a base body of an electric transmission tower using a micropile according to one embodiment of the present disclosure.
Figure 3:
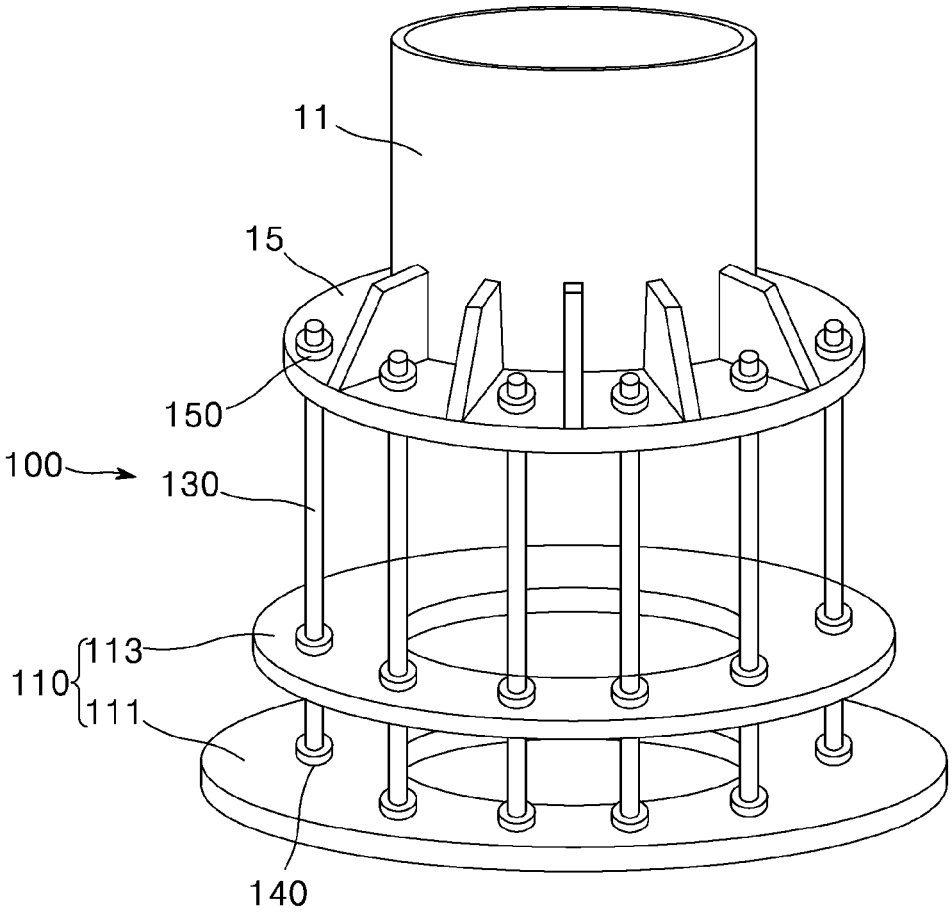
FIG. 3 is a perspective view illustrating a state in which an anchor member is coupled to an electric transmission tower according to one embodiment of the present disclosure.
Figure 4:
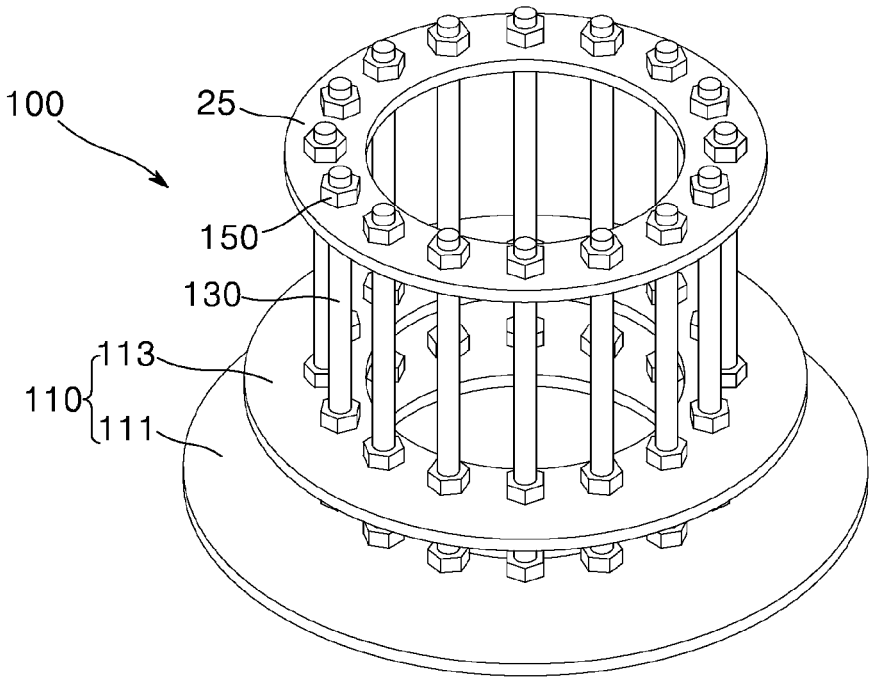
FIG. 4 is a perspective view illustrating an anchor member according to one embodiment of the present disclosure.

FIG. 1 is a diagram illustrating a state in which a base body of an electric transmission tower using a micropile is installed according to one embodiment of the present disclosure, FIG. 2 is a diagram illustrating a cross section of a base body of an electric transmission tower using a micropile according to one embodiment of the present disclosure, FIG. 3 is a perspective view illustrating a state in which an anchor member is coupled to an electric transmission tower according to one embodiment of the present disclosure, and FIG. 4 is a perspective view illustrating an anchor member according to one embodiment of the present disclosure.

Referring to FIGS. 1 to 4, a base body 1 of an electric transmission tower using a micropile according to one embodiment of the present disclosure includes an anchor member 100, a foundation member 200 and a micropile 300.

The anchor member 100 is attachably and detachably coupled to a main pole member 11 of an electric transmission tower 10. In the present embodiment, the anchor member 100 includes an anchor plate 110 and an anchor pole 130.

The anchor plate 110 is coupled to the foundation member 200, and a plurality of anchor plates 110 may be provided to be separated from each other. The anchor plate 110 is fixed inside of the foundation member 200 and is directly coupled to the anchor plate 110 or is indirectly coupled thereto through the anchor pole 130 so that the main pole member 11 is fixed to the foundation member 200 while the main pole member 11 is strongly supported.

The number of anchor plates 110 may be changed according to a scale of the electric transmission tower 10 including the main pole member 11, a size of the foundation member 200, or the like. For convenience of a description, an example in which a first anchor plate 111 and a second anchor plate 113 are two anchor plates 110 will be described.

The first anchor plate 111 and the second anchor plate 113 are each formed as a circular plate in which a hole is formed around a center of the circular plate, and are located to be separated from each other. The first anchor plate 111 and the second anchor plate 113 are configured to include a metal material, and are each provided with a plurality of anchor column inserting holes 140 to enable the anchor pole 130 to be inserted thereinto.

The anchor pole 130 is inserted into each of the plurality of anchor column inserting holes 140 and is coupled to the anchor plate 110 by means of a nut. An upper end of the anchor pole 130 passes through a base 15 of the main pole member 11. The anchor pole 130 is attachably and detachably coupled to the main pole member 11 by means of a main pole member coupler 150, for example, a nut.

The anchor member 100 is embedded in and fixed to the foundation member 200 including a concrete material, specifically, a second foundation 230 which will be described below.

Figure 5:
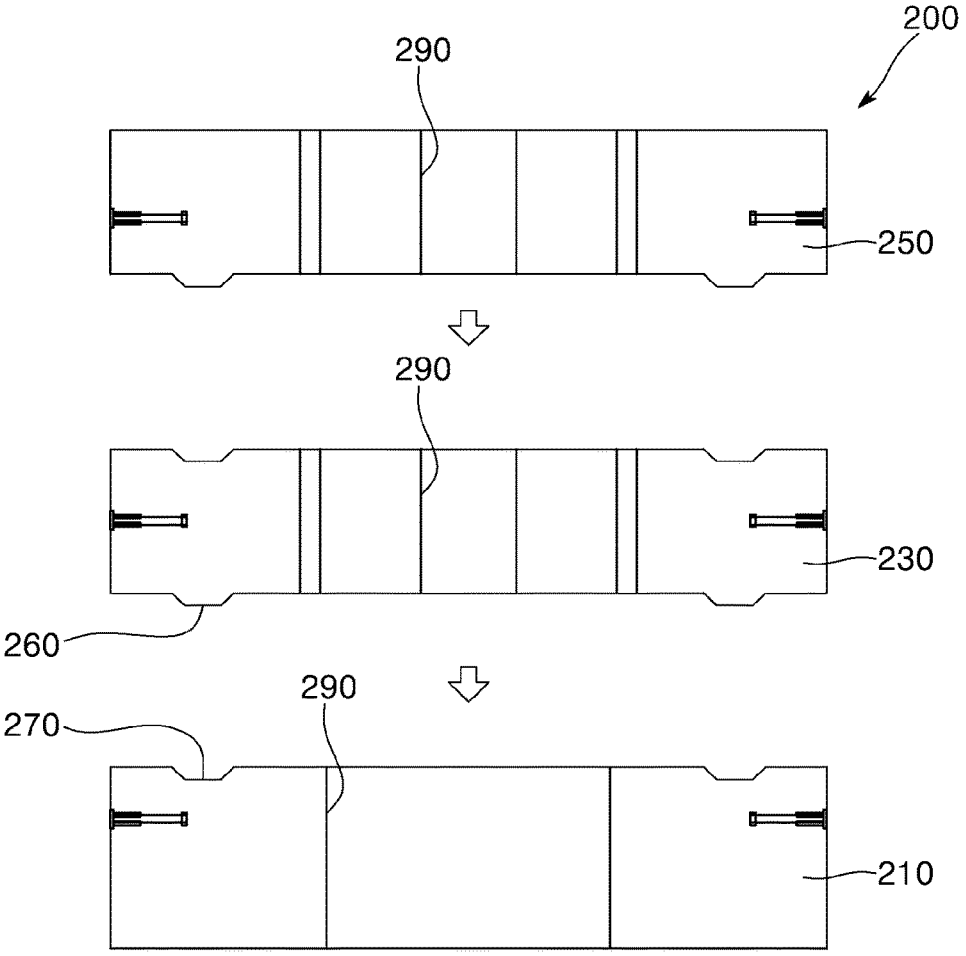
FIG. 5 is a diagram illustrating a configuration of a foundation member according to one embodiment of the present disclosure.
Figure 6:
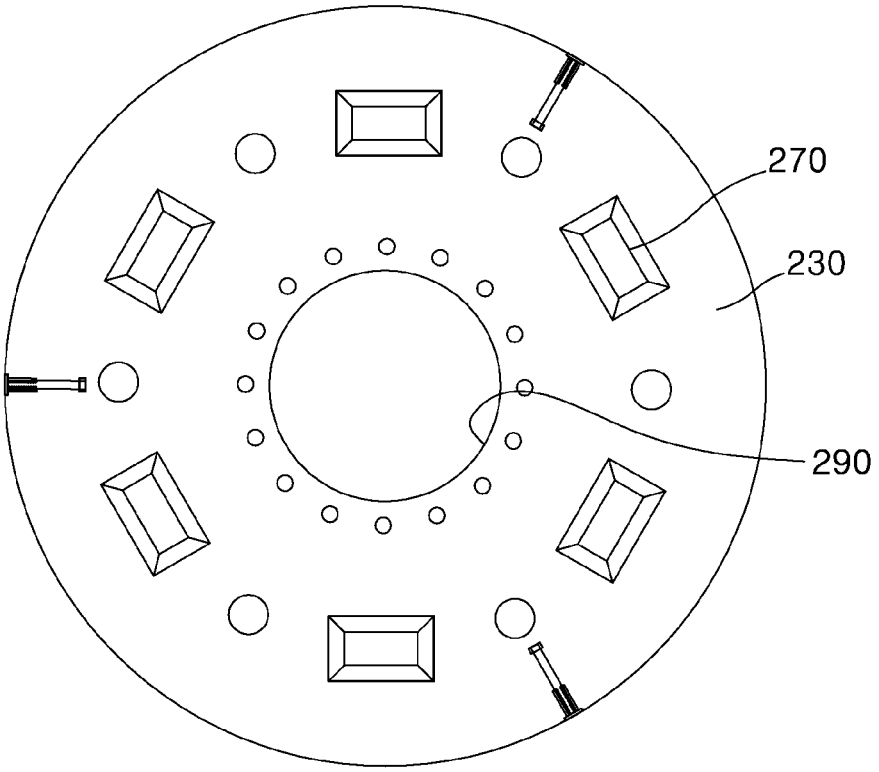
FIG. 6 is a diagram illustrating an upper end of a second foundation part of a foundation member according to one embodiment of the present disclosure.

FIG. 5 is a diagram illustrating a configuration of a foundation member according to one embodiment of the present disclosure, and FIG. 6 is a diagram illustrating an upper end of a second foundation part of a foundation member according to one embodiment of the present disclosure.

Referring to FIGS. 2, 5, and 6, the foundation member 200 is coupled to the anchor member 100, and includes a plurality of foundations 210, 230, and 250 which are precasted before being moved to an installation location. The number of foundations 210, 230, and 250 and a size of each thereof may be adjusted in consideration of a scale of the electric transmission tower 10 and circumstances, for example, wind speed, an amount of rainfall, solidity of the ground, or the like of a location at which the electric transmission tower 10 will be installed.

For convenience of a description, when the number of foundations 210, 230, and 250 is 3, an example in which a first foundation 210 located at a lowermost end, a third foundation 250 located at an uppermost end, and the second foundation 230 located between the first foundation 210 and the third foundation 250 are included will be described.

In the present embodiment, a movement limiting plate 330, which will be described below, is inserted into the first foundation 210, and the first foundation 210 is configured with a concrete material. The first anchor plate 111 and the second anchor plate 113 are inserted into the second foundation 230 in a state in which the first anchor plate 111 and the second anchor plate 113 are coupled to each other by means of the anchor pole 130, and the second foundation 230 is configured with a concrete material.

In the present embodiment, the foundations 210, 230, and 250 are configured with a concrete material, are manufactured in a factory and the like before being transported to the location at which the electric transmission tower 10 will be installed, and are transported to the location by means of a helicopter and the like.

A size and a weight of each of the precasted foundations 210, 230, and 250 may be determined in consideration of movement of the precasted foundations 210, 230, and 250 to a construction location. When being transported by means of a helicopter, each of the precasted foundations 210, 230, and 250 is manufactured below a predetermined weight, for example, 3.5 tons, which the helicopter is capable of transporting.

In the present embodiment, the plurality of foundations 210, 230, and 250 are coupled to each other by engaging a foundation protrusion 260 formed to protrude from each of adjacent surfaces with a foundation depression 270 formed in a concave shape corresponding to the foundation protrusion 260.

The micropile 300 may pass through a pile inserting hole 280 of the foundation member 200 to be coupled to the foundation member 200, fix the foundation member 200 to a ground 50, and counterbalance a corresponding load by compressing the foundation member 200 when a load is applied to the foundation member 200 by means of the main pole member 11. In the present embodiment, the micropile 300 includes a pile part 310, the movement limiting plate 330, and a compressing part 350.

The pile part 310 is coupled to the foundation member 200. One end of the pile part 310 protrudes toward an upper side of the foundation member 200 and the other end thereof is fixed to the ground 50. In the present embodiment, the pile part 310 is configured with a material including a metal material, is formed in an approximate rod shape, and is installed at the ground 50 to be coupled to the foundation member 200. In the present embodiment, a plurality of the pile parts 310 are provided to strongly fix the foundation member 200 to the ground 50.

Figure 7:
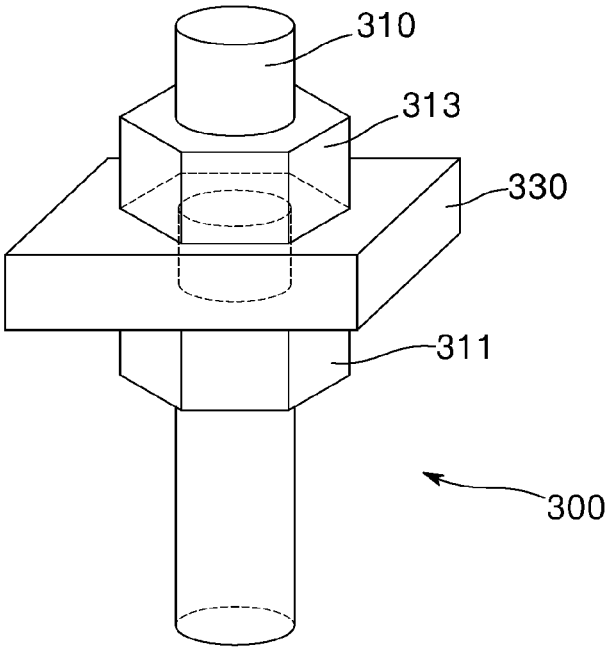
FIG. 7 is a perspective view of a micropile according to one embodiment of the present disclosure.
Figure 8:
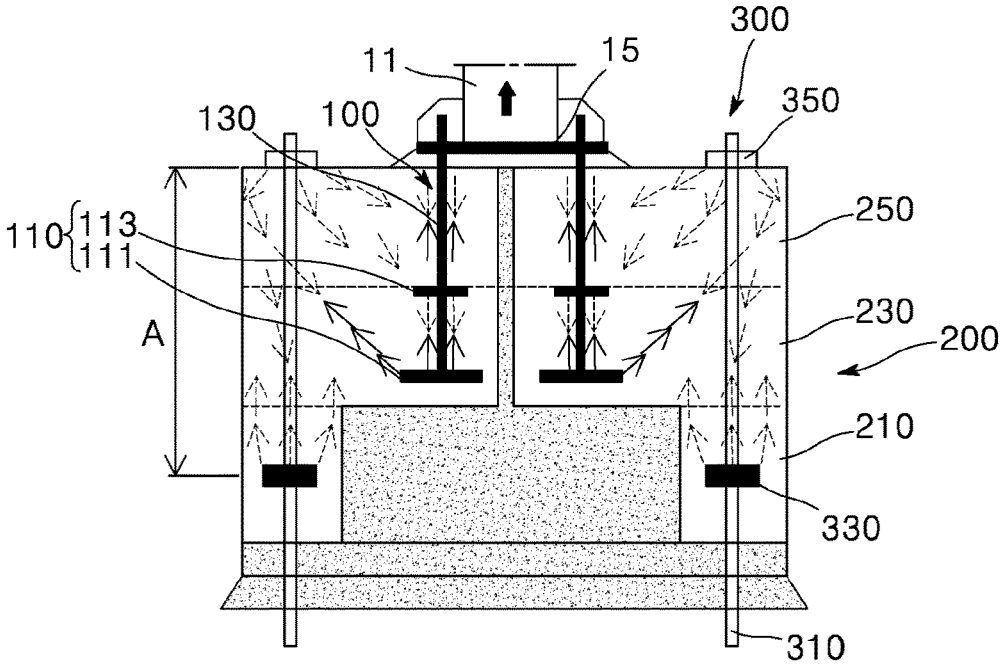
FIG. 8 is a conceptual diagram illustrating an operation of a micropile according to one embodiment of the present disclosure.

FIG. 7 is a perspective view of a micropile according to one embodiment of the present disclosure, and FIG. 8 is a conceptual diagram illustrating an operation of a micropile according to one embodiment of the present disclosure.

Referring to FIGS. 2, 7, and 8, the movement limiting plate 330 is inserted into the foundation member 200 and is coupled to the pile part 310 to limit movement thereof. In the present embodiment, the movement limiting plate 330 is formed in a ring shape and is seated on an upper end of a position fixing lower nut 311, which is screw-coupled to the pile part 310, so that a position thereof is fixed, and movement thereof toward an upper side is limited by means of a position fixing upper nut 313.

In the present embodiment, the movement limiting plate 330 is configured with a material including a metal material, and is inserted into the first foundation 210 to be integrally formed therewith.

The compressing part 350 is located at an upper surface of the foundation member 200 and is coupled to the pile part 310 in a state in which the one end of the pile part 310 is pulled toward the upper side to compress the foundation member 200 toward a lower side. In the present embodiment, the compressing part 350 includes a compressing plate 351 and a pile fixer 353.

The compressing plate 351 is provided so as to come into contact with the upper surface of the foundation member 200, and the pile part 310 passes through the compressing plate 351 to be coupled thereto. In the present embodiment, the compressing plate 351 is configured with a material including a metal material, and is formed in a plate shape through which the pile part 310 passes. The compressing plate 351 distributes a compressive force applied to the foundation member 200 by means of the pile part 310 to prevent damage to the foundation member 200.

The pile fixer 353 is screw-coupled to the pile part 310 and comes into contact with an upper surface of the compressing plate 351 to limit movement of the pile part 310. In the present embodiment, the pile fixer 353 is provided as, for example, a nut and is screw-coupled to the pile part 310.

In the present embodiment, the pile fixer 353 comes into contact with the upper surface of the compressing plate 351 and pressurizes the compressing plate 351 toward the lower side together with the pile part 310 to compress the foundation member 200.

The micropile 300 is fixed to the foundation member 200 by means of the movement limiting plate 330 so that a region of the foundation member 200, which is compressed by means of the micropile 300, corresponds to a region (a region A in FIG. 8) between the movement limiting plate 330 and the compressing plate 351.

In the present embodiment, the micropile 300 further includes a pile cap part 370. The pile cap part 370 is provided to surround the upper end of the pile part 310 and the pile fixer 353 so that the pile part 310 and the pile fixer 353 are prevented from being exposed to the outside. In the present embodiment, the pile cap part 370 includes a pile cap 371 and a cap filler 373

The pile cap 371 is formed in a shape that surrounds the upper end of the pile part 310 and the pile fixer 353. In the present embodiment, the pile cap 371 includes a metal material and is formed in an approximate cylindrical shape having an open lower surface.

The cap filler 373 is injected inside the pile cap 371 and prevents corrosion thereof. In the present embodiment, the cap filler 373 prevents air, moisture, and the like from flowing between the pile cap 371 and the compressing plate 351 to prevent corrosion of the pile part 310 or the pile fixer 353.

Hereinafter, a construction method, an operation principle, and effects of the base body 1 of an electric transmission tower using a micropile according to one embodiment of the present disclosure will be described below.

Figure 9:
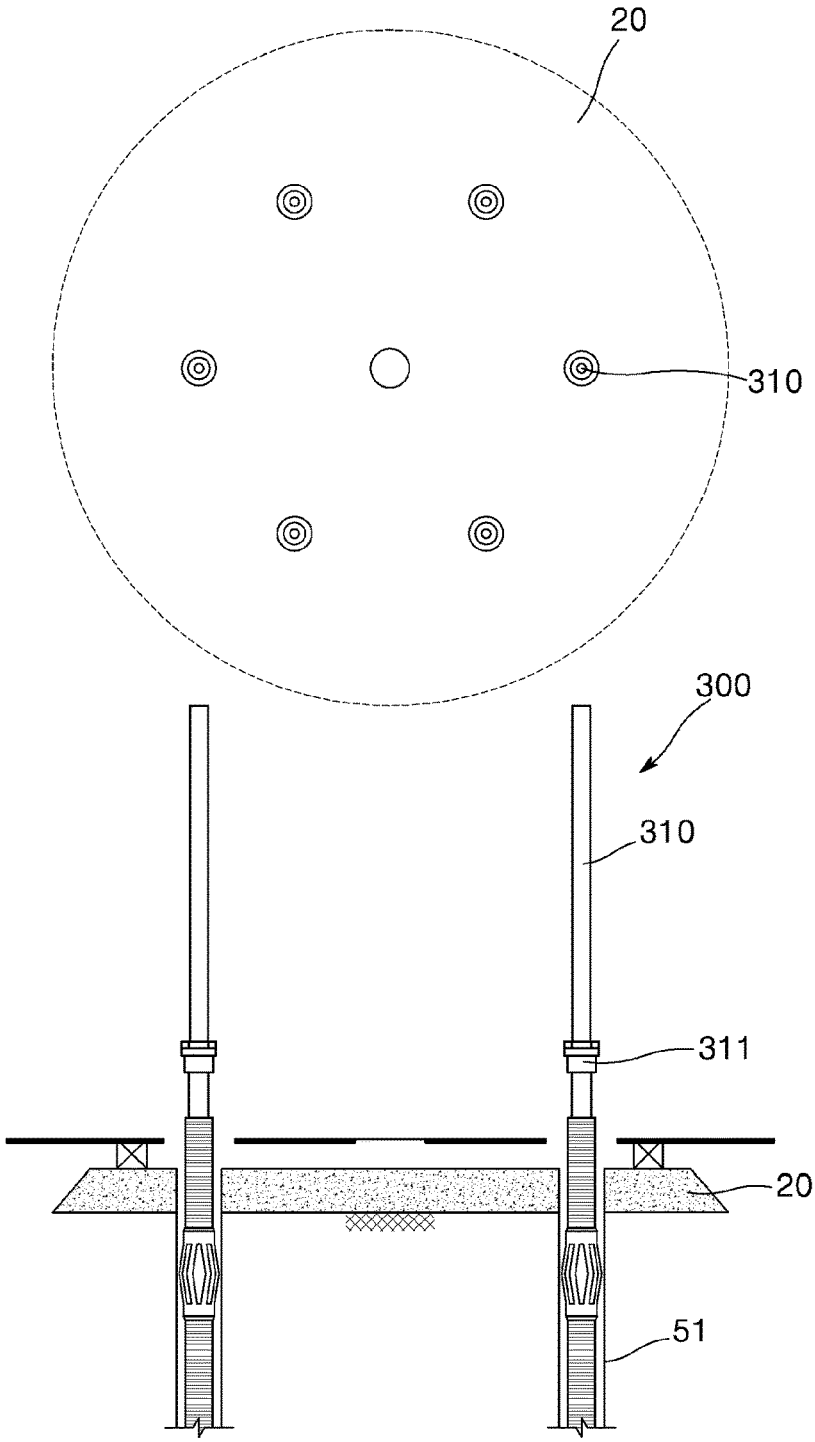
FIG. 9 is a diagram illustrating a state in which a micropile is fixed to the ground in a base body of an electric transmission tower using a micropile according to one embodiment of the present disclosure.

FIG. 9 is a diagram illustrating a state in which a micropile is fixed to the ground in a base body of an electric transmission tower using a micropile according to one embodiment of the present disclosure. Referring to FIG. 9, a punched hole 51 is formed at the ground 50 corresponding to a position at which the electric transmission tower 10 will be installed by means of a drilling machine (not shown), and then the pile part 310 is inserted into the punched hole 51.

To prevent a position into which the pile part 310 is inserted from moving, a leveling concrete 20 may be casted on an upper surface of the ground 50 or a pile jig 25 which is connected to the pile part 310 may be applied to the upper surface of the ground 50. When the pile part 310 is installed, the position fixing lower nut 311 for fixing a position of the first foundation 210 is screw-coupled to the pile part 310.

Figure 10:
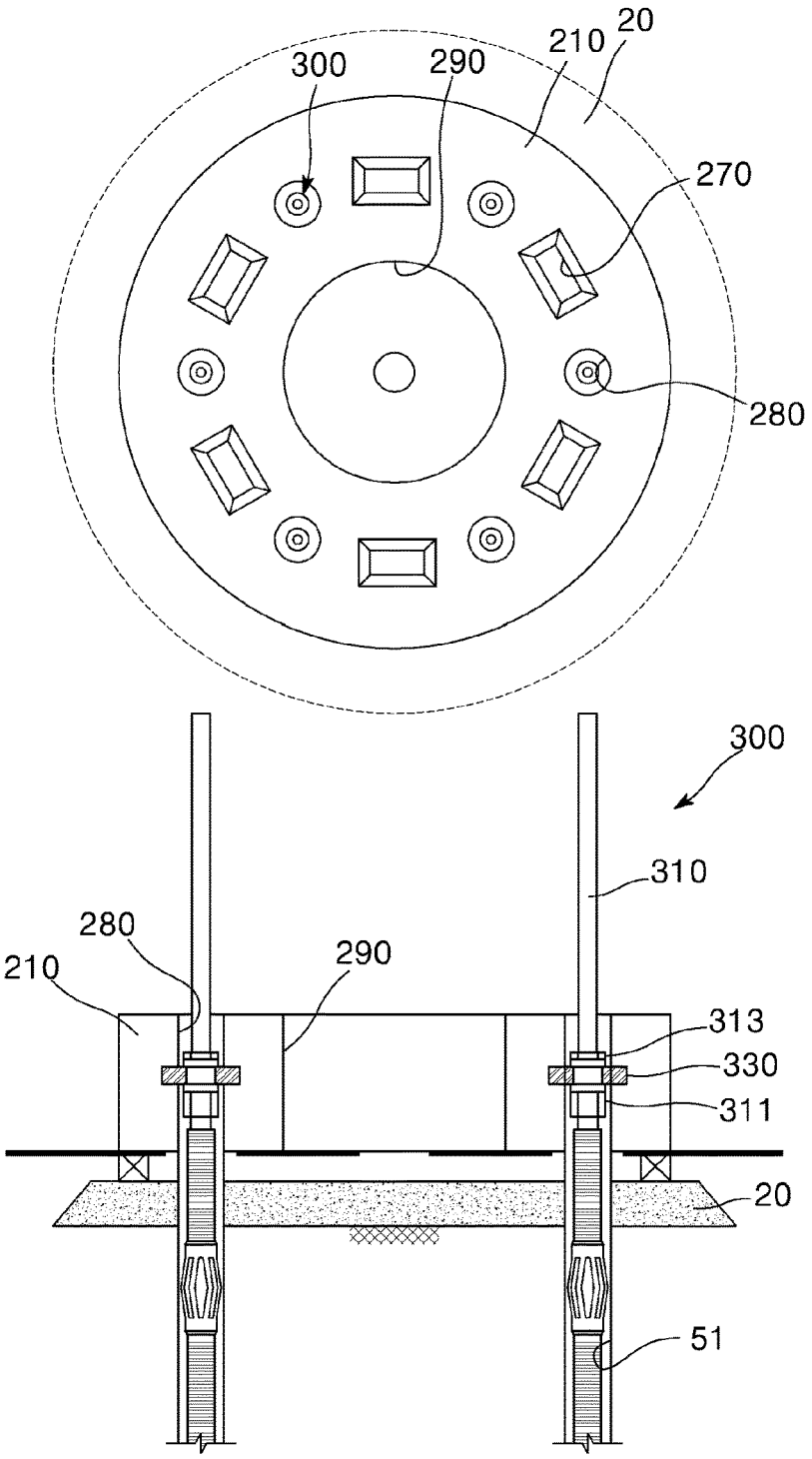
FIG. 10 is a diagram illustrating a state in which a first foundation part is installed in a base body of an electric transmission tower using a micropile according to one embodiment of the present disclosure.

FIG. 10 is a diagram illustrating a state in which a first foundation part is installed in a base body of an electric transmission tower using a micropile according to one embodiment of the present disclosure. Referring to FIG. 10, after the position fixing lower nut 311 is coupled to the pile part 310, the first foundation 210 is moved in a direction toward a lower side thereof from an upper side thereof to enable the pile part 310 to be inserted into the first foundation 210.

Since the movement limiting plate 330 is embedded in the first foundation 210, the first foundation 210 is continuously moved in a lower side direction until the movement limiting plate 330 is seated on the position fixing lower nut 311, and thus the movement limiting plate 330 is finally seated thereon to fix a position of the first foundation 210. When the first foundation 210 is coupled at a predetermined position on the pile part 310, movement of the movement limiting plate 330 and the first foundation 210 is limited in an upper side direction by means of a position fixing upper nut 313.

Figure 11:
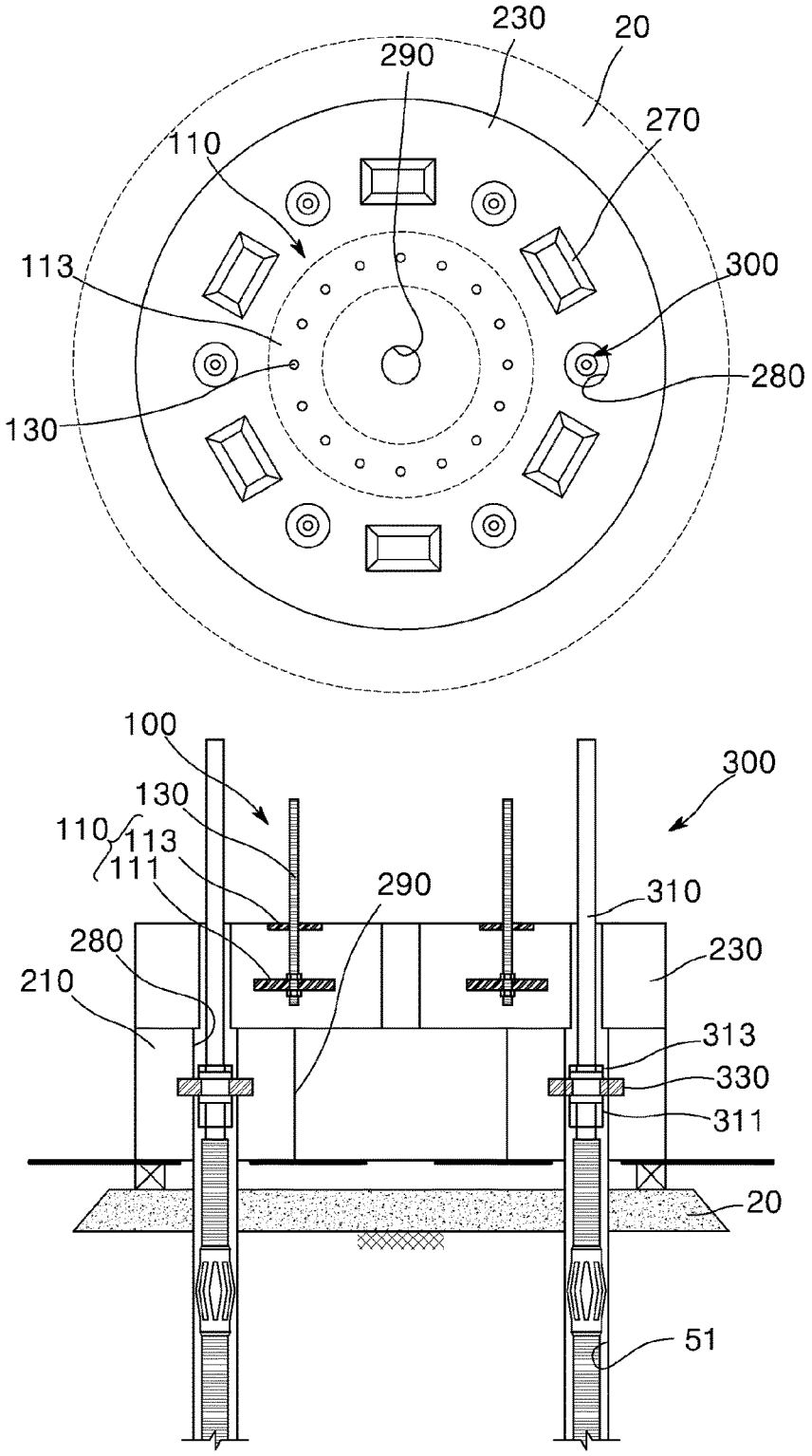
FIG. 11 is a diagram illustrating a state in which a second foundation part is installed in a base body of an electric transmission tower using a micropile according to one embodiment of the present disclosure.

FIG. 11 is a diagram illustrating a state in which a second foundation part is installed in a base body of an electric transmission tower using a micropile according to one embodiment of the present disclosure. Referring to FIG. 11, after the position of the first foundation 210 is fixed, the second foundation 230 is moved from the upper side toward the lower side and is seated on an upper surface of the first foundation 210.

When the second foundation 230 is seated on the first foundation 210, the foundation protrusion 260 provided at a lower surface of the second foundation 230 is engaged with the foundation depression 270 provided at the upper surface of the first foundation 210 so that a relative movement between the second foundation 230 and the first foundation 210 is limited.

Figure 12:
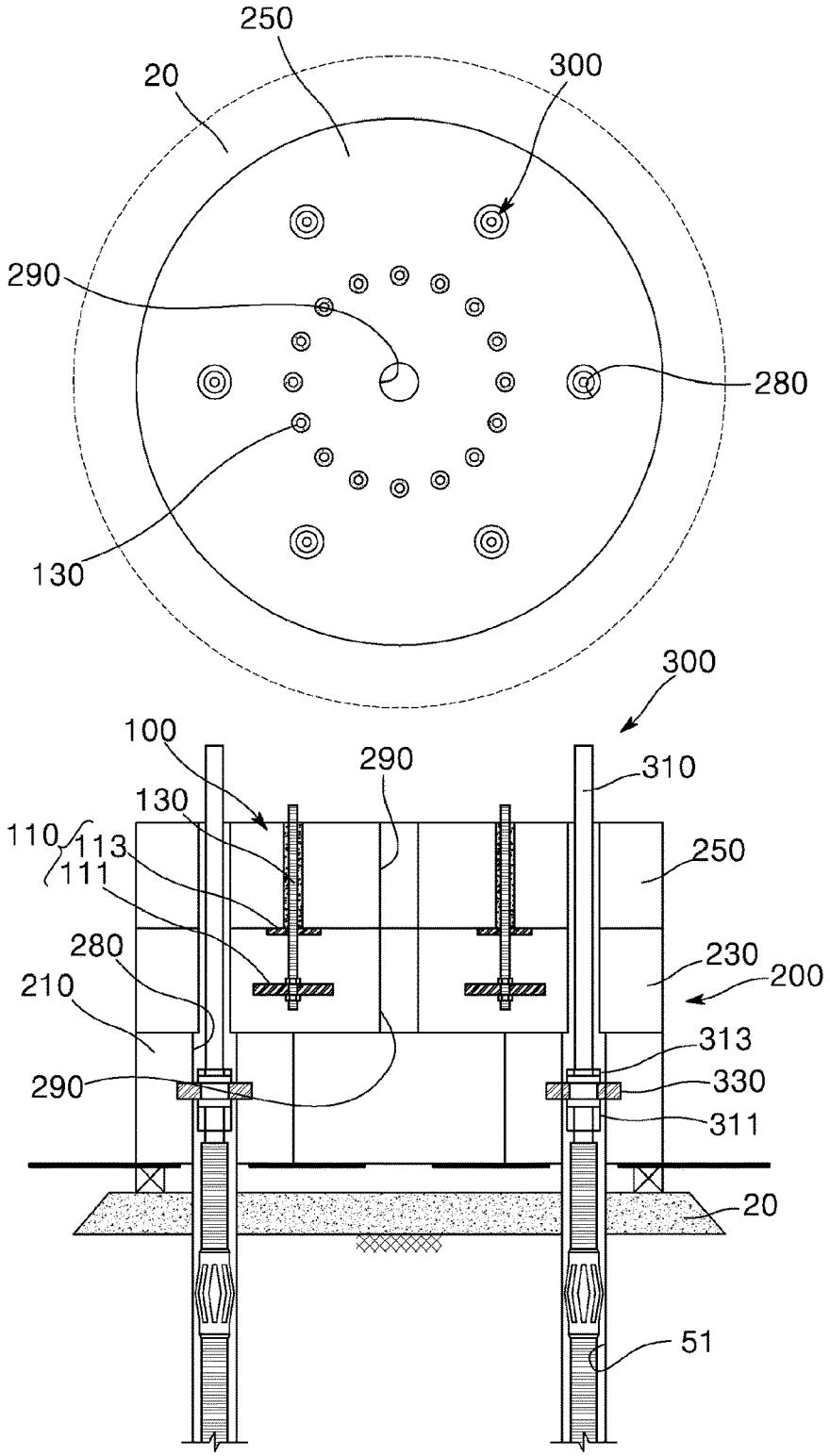
FIG. 12 is a diagram illustrating a state in which a third foundation part is installed in a base body of an electric transmission tower using a micropile according to one embodiment of the present disclosure.

FIG. 12 is a diagram illustrating a state in which a third foundation part is installed in a base body of an electric transmission tower using a micropile according to one embodiment of the present disclosure. Referring to FIG. 12, after the second foundation 230 is seated on the first foundation 210, the third foundation 250 is seated on an upper surface of the second foundation 230 so that the foundation protrusion 260 of the third foundation 250 is engaged with the foundation depression 270 of the second foundation 230.

Also, interfaces between the first foundation 210 and the second foundation 230 and between the second foundation 230 and the third foundation 250 may be cleaned by blowing air thereto and then a bonding epoxy may be applied to the interfaces to reinforce couplings therebetween.

Figure 13:
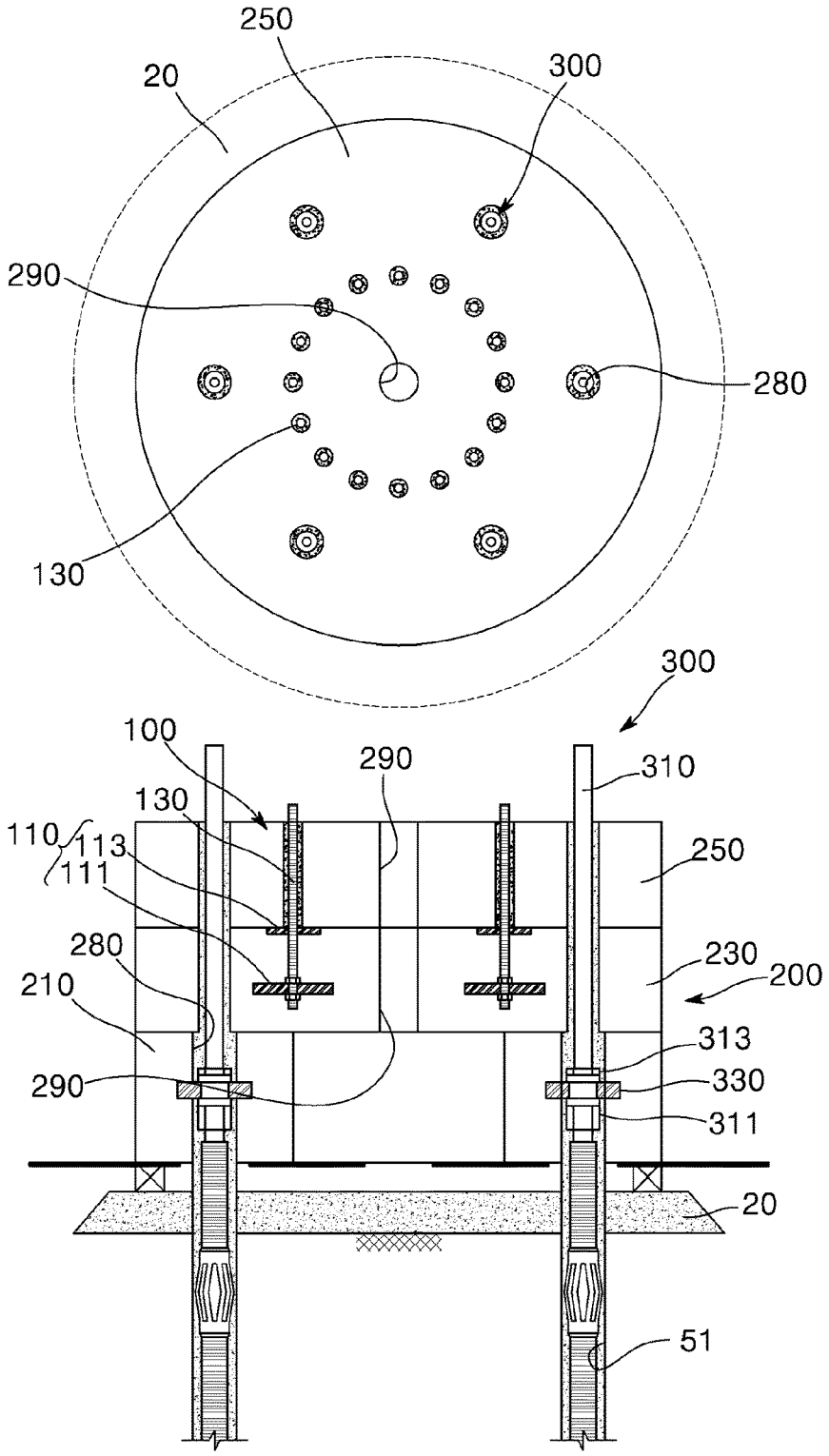
FIG. 13 is a diagram illustrating a state in which a micropile and a foundation member are coupled to each other in a base body of an electric transmission tower using a micropile according to one embodiment of the present disclosure.
Figure 14:
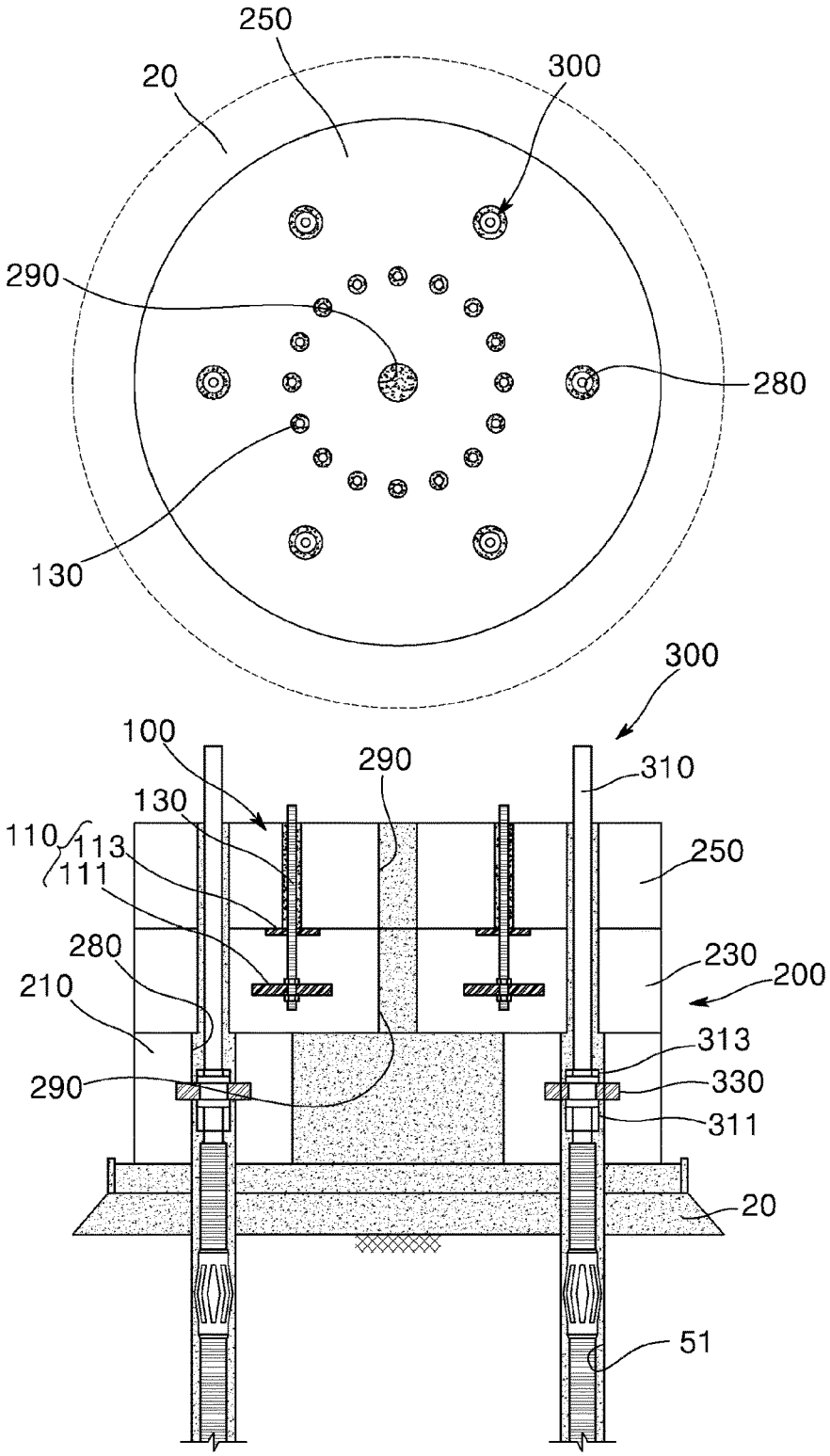
FIG. 14 is a diagram illustrating a state in which a non-contracting mortar is injected into a base body of an electric transmission tower using a micropile according to one embodiment of the present disclosure.

FIG. 13 is a diagram illustrating a state in which a micropile and a foundation member are coupled to each other in a base body of an electric transmission tower using the micropile according to one embodiment of the present disclosure, and FIG. 14 is a diagram illustrating a state in which a non-contracting mortar is injected into a base body of an electric transmission tower using a micropile according to one embodiment of the present disclosure.

Referring to FIGS. 13 and 14, after the second foundation 230 and the third foundation 250 are seated over the first foundation 210, the punched hole 51 of the first foundation 210 is grouted to strongly fix the pile part 310 to the ground 50, and then a non-contracting mortar is injected into an injection hole 290 which is formed at an approximate center of each of the foundations 210, 230, and 250.

Figure 15:
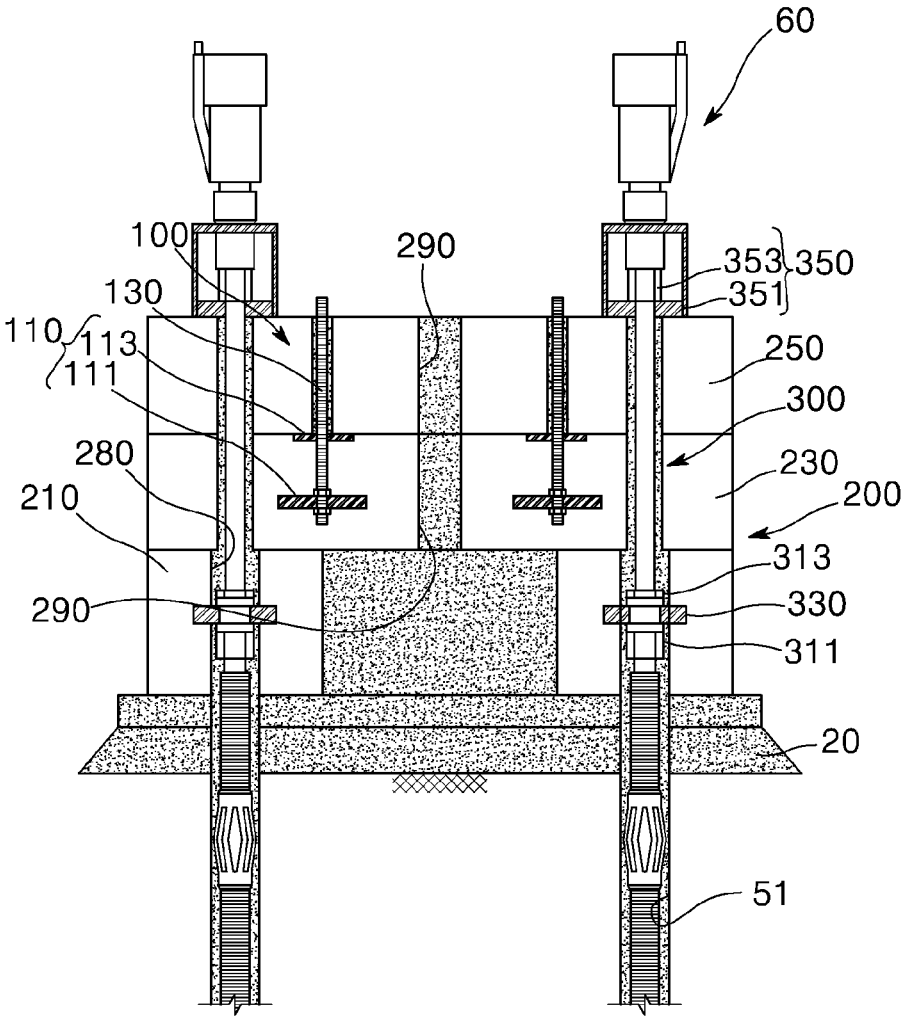
FIG. 15 is a diagram illustrating a state in which a tensile force is applied to a pile part in a base body of an electric transmission tower using a micropile according to one embodiment of the present disclosure.

FIG. 15 is a diagram illustrating a state in which a tensile force is applied to a pile part in a base body of an electric transmission tower using a micropile according to one embodiment of the present disclosure. Referring to FIG. 15, when the non-contracting mortar is injected into the injection hole 290 and the first foundation 210, the second foundation 230, and the third foundation 250 are strongly coupled to each other, the pile part 310 is extended toward the upper side using the compressing plate 351 and a steel rod tensioner 60 while the pile fixer 353 is simultaneously coupled to the pile part 310 to compress the foundation member 200 between the compressing plate 351 and the movement limiting plate 330 by means of residual stress of the pile part 310.

Figure 16:
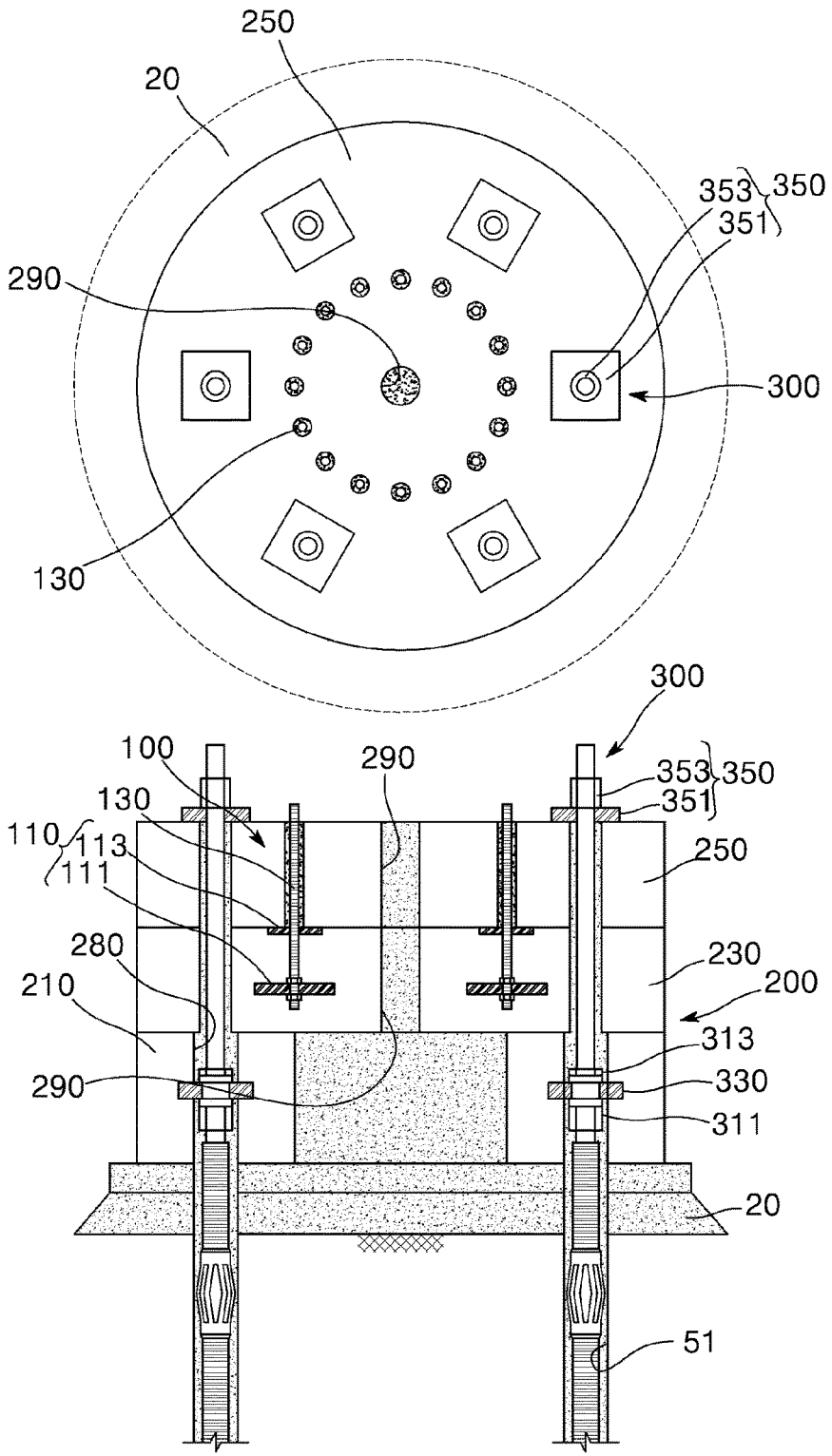
FIG. 16 is a diagram illustrating a state in which an upper end of a pile part is fixed in a base body of an electric transmission tower using a micropile according to one embodiment of the present disclosure.

FIG. 16 is a diagram illustrating a state in which an upper end of a pile part is fixed in a base body of an electric transmission tower using a micropile according to one embodiment of the present disclosure. Referring to FIG. 16, when the extension of the pile part 310 is completed, the punched hole 51 of each of the first foundation 210 and the second foundation 230 is grouted through a compressing plate hole (not shown) which is formed to vertically pass through the compressing plate 351.

Figure 17:
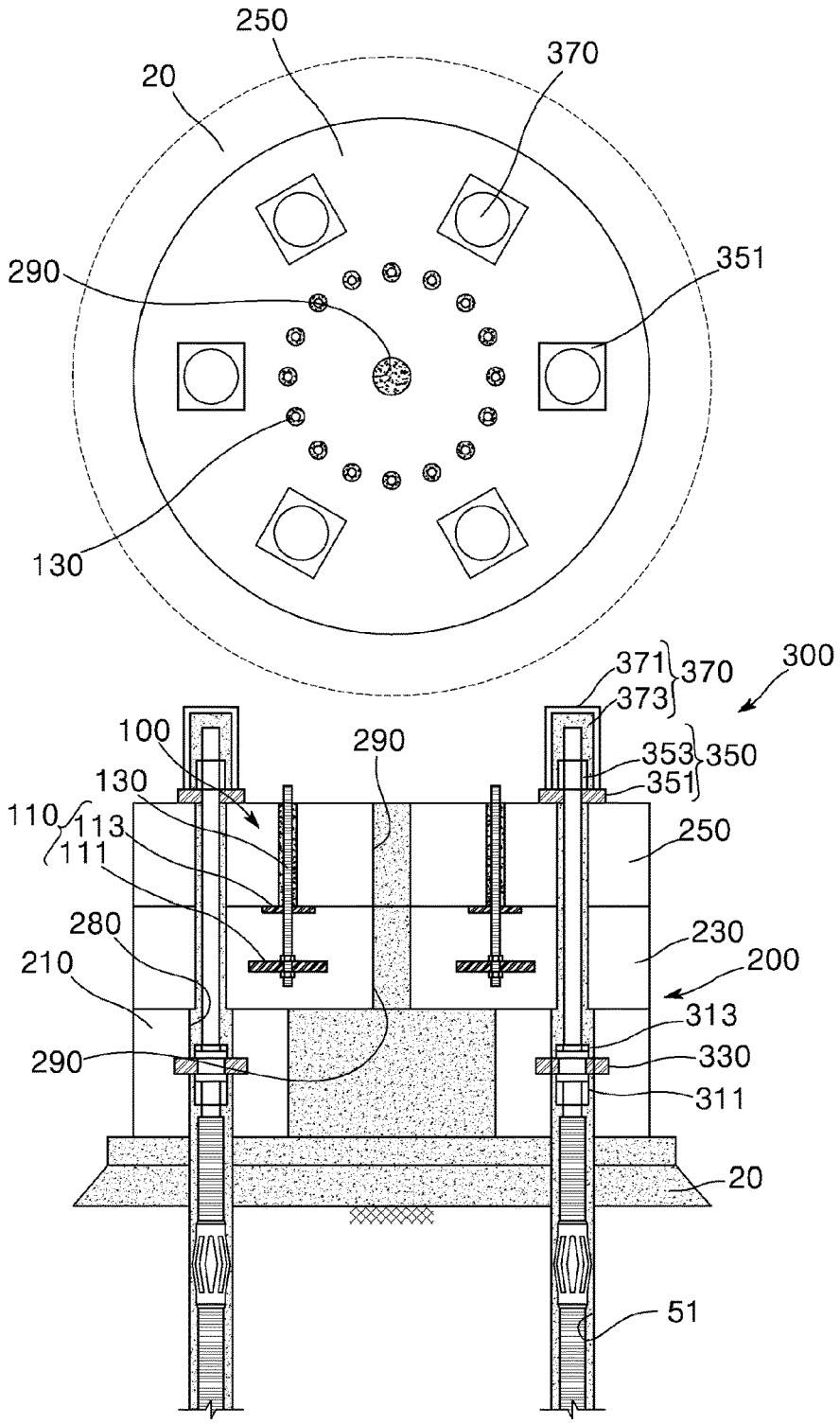
FIG. 17 is a diagram illustrating a state in which a pile cap part is installed at a base body of an electric transmission tower using a micropile according to one embodiment of the present disclosure.

FIG. 17 is a diagram illustrating a state in which a pile cap part is installed at a base body of an electric transmission tower using a micropile according to one embodiment of the present disclosure. Referring to FIG. 17, when the grouting of the punched hole 51 of each of the first foundation 210 and the second foundation 230 is completed, the pile cap 371 is installed and then the cap filler 373 is injected into the pile cap 371.

In the base body 1 of an electric transmission tower using a micropile according to the present embodiment, the foundation member 200 includes the plurality of foundations 210, 230, and 250 which are factory manufactured and are assembled through a simplified process so that it is possible to reduce a period of time, costs, and manpower required for installing the foundation member 200, and environmental damage.

Also, in the present embodiment, since the base body 1 of an electric transmission tower using a micropile compresses the foundation member 200 using the micropile 300 (compression acts in a dotted arrow direction of FIG. 8) so that a tensile force (that acts in a solid line arrow direction of FIG. 8), which is generated when a wind load or the like is applied to the electric transmission tower 10, may be counterbalanced, and durability of the foundation member 200 may be improved.

Further, in the present embodiment, the base body 1 of an electric transmission tower using a micropile is provided with the pile cap part 370 so that corrosion of the pile part 310 may be prevented and a performance of the device may be maintained.

Although the present disclosure has been described by way of embodiments shown in the accompanying drawings, they are merely illustrative embodiments, and those skilled in the art should understand that numerous other alternations and equivalent other embodiments can be devised therefrom. Therefore, the true technical scope of the present disclosure should be defined by the appended claims.

The invention claimed is:

1. A base body of an electric transmission tower using a micropile, comprising:

an anchor member coupled to a main pole member of the electric transmission tower;

a foundation member coupled to the anchor member and including a plurality of foundations; and the micropile configured to fix the foundation member to a ground and compress the foundation member, wherein the anchor member includes:

a plurality of anchor plates coupled to the foundation member and separated from each other, the plurality of anchor plates disposed inside the foundation member; and an anchor pole configured to connect the plurality of anchor plates to each other and be attachably and detachably coupled to the main pole member, wherein an upper end of the anchor pole passes through a base of the main pole member, the base disposed outside the foundation member and separated from the plurality of anchor plates, and wherein at least one anchor plate of the plurality of anchor plates is disposed in a middle layer of the plurality of foundations.

2. The base body of claim 1, wherein each of the plurality of anchor plates is formed in a plate shape, and the anchor pole passes through each of the plurality of anchor plates to be coupled thereto.

3. The base body of claim 1, wherein each of the plurality of foundations is precasted and coupled to the micropile.

4. The base body of claim 1, wherein the foundation member includes:

a first foundation part seated on the ground or leveled concrete and coupled to the micropile so that a position of the first foundation part is fixed;

a second foundation part seated on the first foundation part and to which the anchor member is coupled; and a third foundation part seated on the second foundation part and pressurized toward the second foundation part by the micropile.

5. The base body of claim 1, wherein the plurality of the foundations are coupled to each other by a foundation protrusion formed to protrude from each of adjacent surfaces being engaged with a foundation depression formed in a concave shape corresponding to the foundation protrusion.

6. The base body of claim 5, wherein the foundation protrusion is disposed in a circumferential direction based on a central axis of the foundation member.

7. The base body of claim 1, wherein the micropile includes:

a pile part coupled to the foundation member and having one end protruding toward an upper side of the foundation member and the other end fixed to the ground; and a movement limiting plate inserted into the foundation member and coupled to the pile part to limit movement of the pile part.

8. The base body of claim 7, wherein the micropile further includes a compressing part coupled to the pile part in a state in which the one end of the pile part is pulled toward an upper side of the foundation member, and configured to come into contact with an upper side of the foundation member and compress the foundation member.

9. The base body of claim 8, wherein the compressing part includes:

a compressing plate provided to come into contact with an upper surface of the foundation member and through which the pile part passes; and a pile fixer screw-coupled to the pile part, and configured to come into contact with an upper surface of the compressing plate and limit movement of the pile part.

10. The base body of claim 9, wherein the micropile further includes a pile cap part provided to surround one end of the pile part and the pile fixer, and configured to prevent the pile part and the pile fixer from being exposed to an outside.

11. The base body of claim 10, wherein the pile cap part includes:

a pile cap formed in a shape that surrounds the one end of the pile part and the pile fixer; and a cap filler injected into the pile cap and configured to prevent corrosion of the pile part.

* * * * *